US005803204A

United States Patent [19]

White et al.

[11] Patent Number: 5,803,204

[45] Date of Patent: Sep. 8, 1998

[54] PERSONNEL LIFT WITH CLAMSHELL CAGE ASSEMBLY

[75] Inventors: David D. White, Fresno, Calif.; Alan E. Murphy, Kingston, Wash.

[73] Assignee: UpRight, Inc., Selma, Calif.

[21] Appl. No.: 787,024

[22] Filed: Jan. 28, 1997

Related U.S. Application Data

[63] Continuation-in-part of Ser. No. 609,823, Mar. 1, 1996, abandoned, which is a continuation of Ser. No. 546,764, Oct. 23, 1995, abandoned.

[51] Int. Cl.[6] ..... B66B 9/20

[52] U.S. Cl. ..... 182/148; 182/2.7

[58] Field of Search ..... 182/148, 141, 182/113, 63.1, 69.4, 2.7

[56] References Cited

U.S. PATENT DOCUMENTS

| | | | |
|---|---|---|---|
| 4,015,686 | 4/1977 | Bushnell | 182/148 |
| 4,657,112 | 4/1987 | Ream | 182/141 |
| 5,052,521 | 10/1991 | Wendt | 182/148 |
| 5,273,132 | 12/1993 | Sasaki | 182/148 |

*Primary Examiner*—Alvin C. Chin-Shue
*Attorney, Agent, or Firm*—Bruce H. Johnsonbaugh

[57] ABSTRACT

A clamshell cage assembly is provided for use in conjunction with a portable personnel lift. The personnel lift may be either a jib boom lift or a lift having a multi-sectional telescoping mast. The clamshell cage assembly has an upper and mid-level safety rail, portions of which pivot to a raised position which facilitates easy entry into the cage wherein the user does not have to stoop or use either hand to hold the cage open. The movable section of safety rail is then pulled downwardly by the user once he has entered the cage.

10 Claims, 13 Drawing Sheets

102
20
100
101
244
30
241
240
242
22
243

PERSONNEL LIFT WITH CLAMSHELL CAGE ASSEMBLY

CROSS REFERENCE TO RELATED APPLICATION

This application is a continuation-in-part of application Ser. No. 08/609,823, filed Mar. 1, 1996, abandoned, which was a continuation of application Ser. No. 08/546,764 filed Oct. 23, 1995. Application Ser. No. 08/546,764 filed Oct. 23, 1995 is now abandoned.

BACKGROUND AND SUMMARY OF THE INVENTION

The present invention relates in general to personnel lifts. More specifically, the invention relates to portable personnel lifts wherein a platform and cage assembly are elevated to working heights of the order of magnitude of 50 feet. According to the present invention, a movable platform and cage assembly is provided which provides a ground level entry for the user in its lowermost position and wherein the platform and cage assembly may be lifted relative to the supporting mast at any time to a position above the top of the supporting mast to eliminate work envelope obstructions by the mast. Another aspect of the present invention is an improved cage assembly having a "clamshell" design wherein a portion of the safety cage is simply lifted up out of the way before a user enters the cage. The movable cage portion is held open automatically, allowing the user to enter the cage without stooping and without having to use either hand. The user may step into the cage standing upright and carrying tools or supplies in both hands. The prior art includes multi-stage personnel lifts such as shown in the Neubauer et al U.S. Pat. No. 5,337,858 dated Aug. 16, 1994. The Neubauer patent teaches a lift wherein the cage assembly is carried by the last of several cantilevered elevating sections. Although the platform and cage assembly of this Neubauer patent is raised above the mast as the platform is elevated, the design has an inherent critical flaw. That critical flaw is that the design utilizes a series of cantilevered elevating sections. The use of cantilevered sections places design limits on stability as working heights are steadily increased.

Another type of prior art mechanism is shown in the Ream et al U.S. Pat. No. 4,657,112 dated Apr. 14, 1987, which patent is owned by the assignee of this application. The Ream et al patent discloses a telescoping mast, as opposed to a cantilevered mast. The telescoping mast is inherently capable of reaching much higher working heights than the cantilevered mast. However, as the working heights are increased, the user of the lift taught in the Ream et al patent must climb higher and higher to enter the cage assembly. For example, the Ream et al U.S. Pat. No. 4,657,112 shows in FIG. 1 the telescoping mast at its lowermost position. In this position, the user must climb ladder 19 to enter the cage 17. As taller and taller lifts are provided, the user must climb taller ladders to enter the cage in its lowermost or retracted position.

The prior art includes cage assemblies with fixed upper rails in which the user must stoop to enter (U.S. Pat. No. 4,657,112); and cage assemblies in which the user must move or lift a mid-level rail to an open position and hold the rail in that position while entering the cage.

According to the present invention, a lift is provided having the advantageous telescoping mast as taught, for example, in the Ream et al U.S. Pat. No. 4,657,112 but which has a movable cage assembly which is capable of being lowered to provide a ground level entry for the user and which also provides means for readily lifting the cage assembly to a position above the top of the mast to remove work envelope obstructions and to increase the overall working height obtainable by the lift.

A primary object of the present invention is to provide a movable cage assembly for use with a telescoping mast personnel lift which provides ground level entry for the user and which provides means for raising the cage above the top of the mast to eliminate work envelope obstructions by the mast.

A further object of the invention is to provide a portable personnel lift having a telescoping mast inherently capable of achieving working heights previously unattained in this art and which simultaneously provides ground level entry for the user and eliminates work envelope obstructions by the mast.

Another object of the invention is to provide a cage assembly having a "clamshell" or pivoting design, affording convenient access to the cage from ground level in that the user need not stoop and may step into the cage without having to grab a rail with either hand.

A further object of the invention is to provide a clam-shell cage assembly capable of being used on a jib boom.

Other objects and advantages of the invention will become apparent from the following description of the drawings wherein:

DETAILED DESCRIPTION OF THE DRAWINGS

Figure 1:
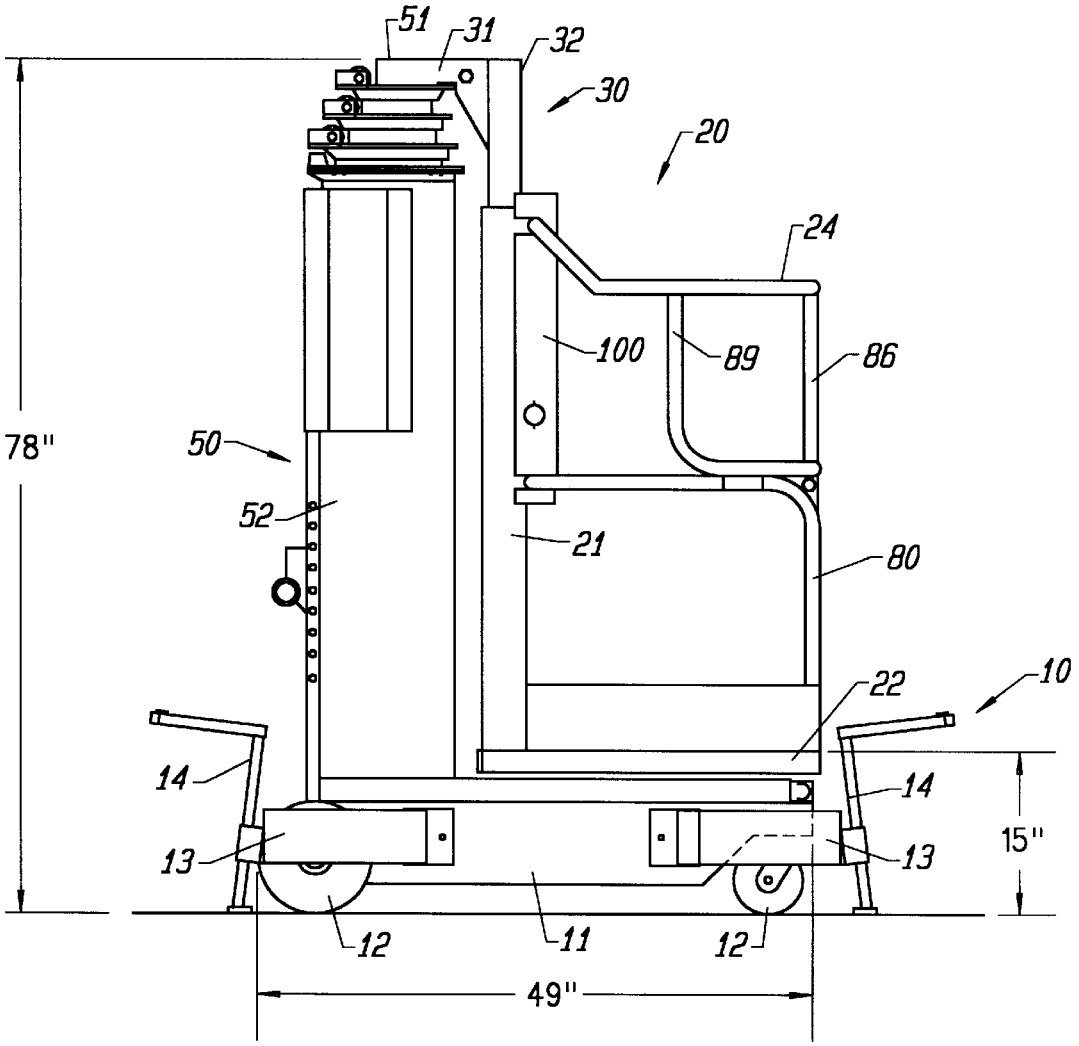
FIG. 1 is a side elevational view of the movable cage assembly according to the invention shown in its retracted or lowermost position in conjunction with a 25 foot telescoping mast.
Figure 2:
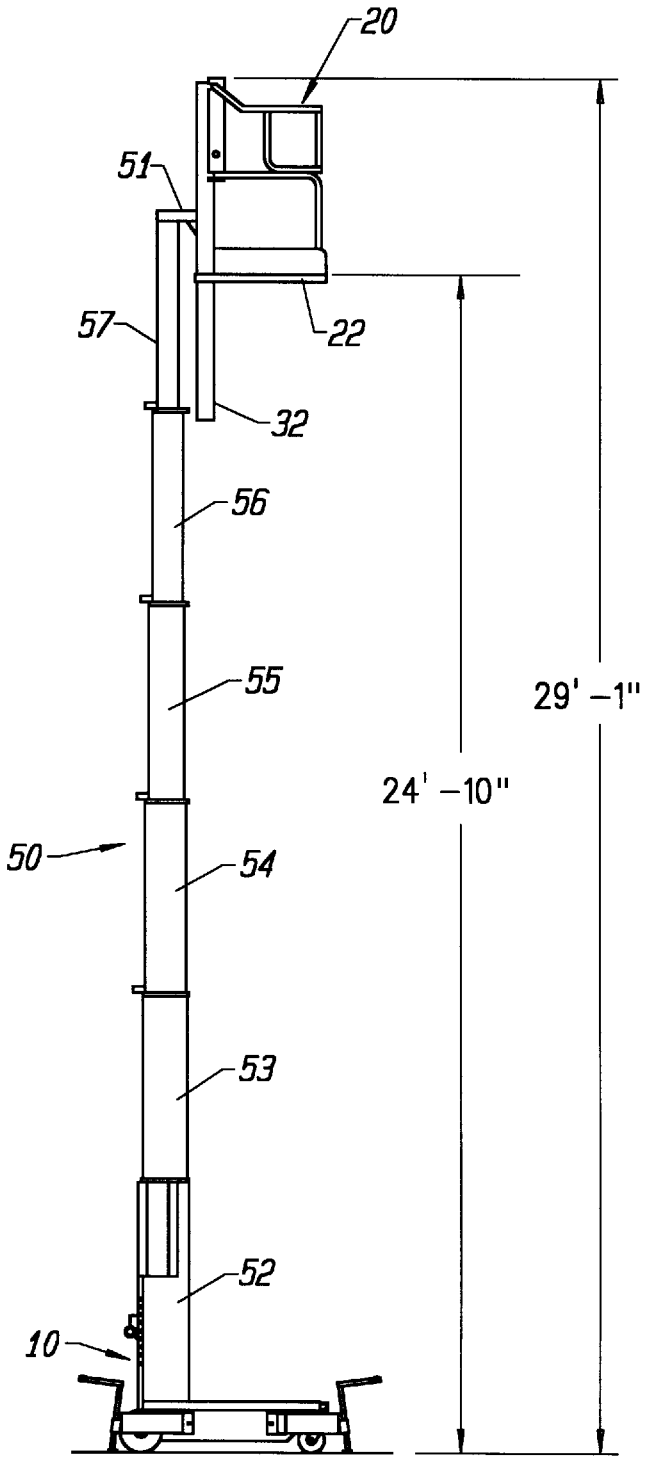
FIG. 2 is a side elevational view of the movable cage assembly shown in FIG. 1 in its elevated position with the movable cage above the top of the mast.
Figure 4:
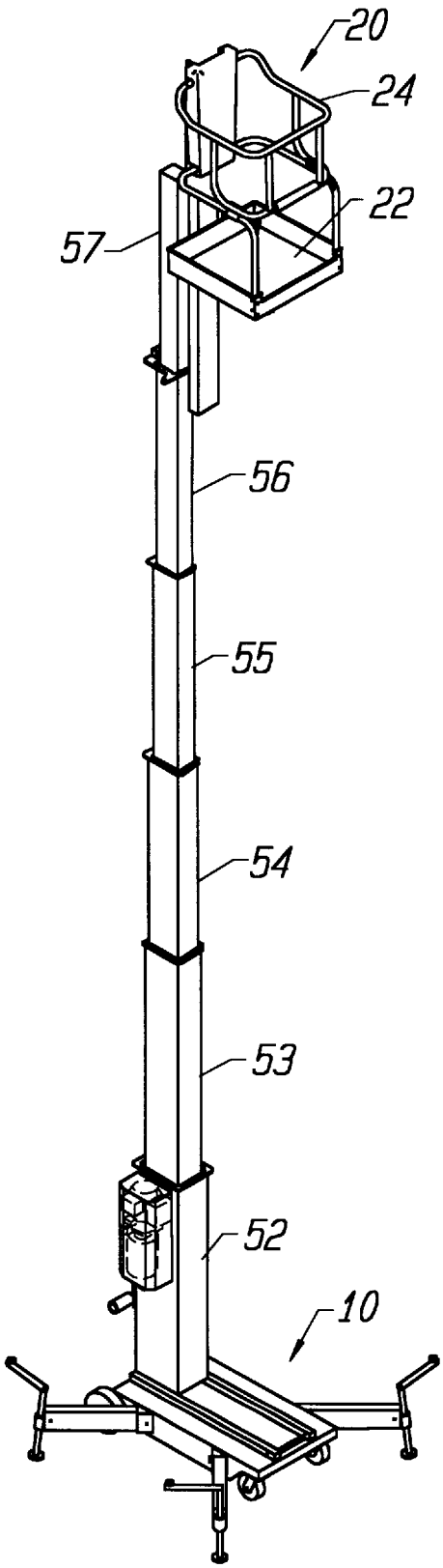
FIG. 4 is a perspective view of the movable cage assembly and telescoping lift of FIG. 3 as shown in its extended position with the cage above the top of the mast.
Figure 5:
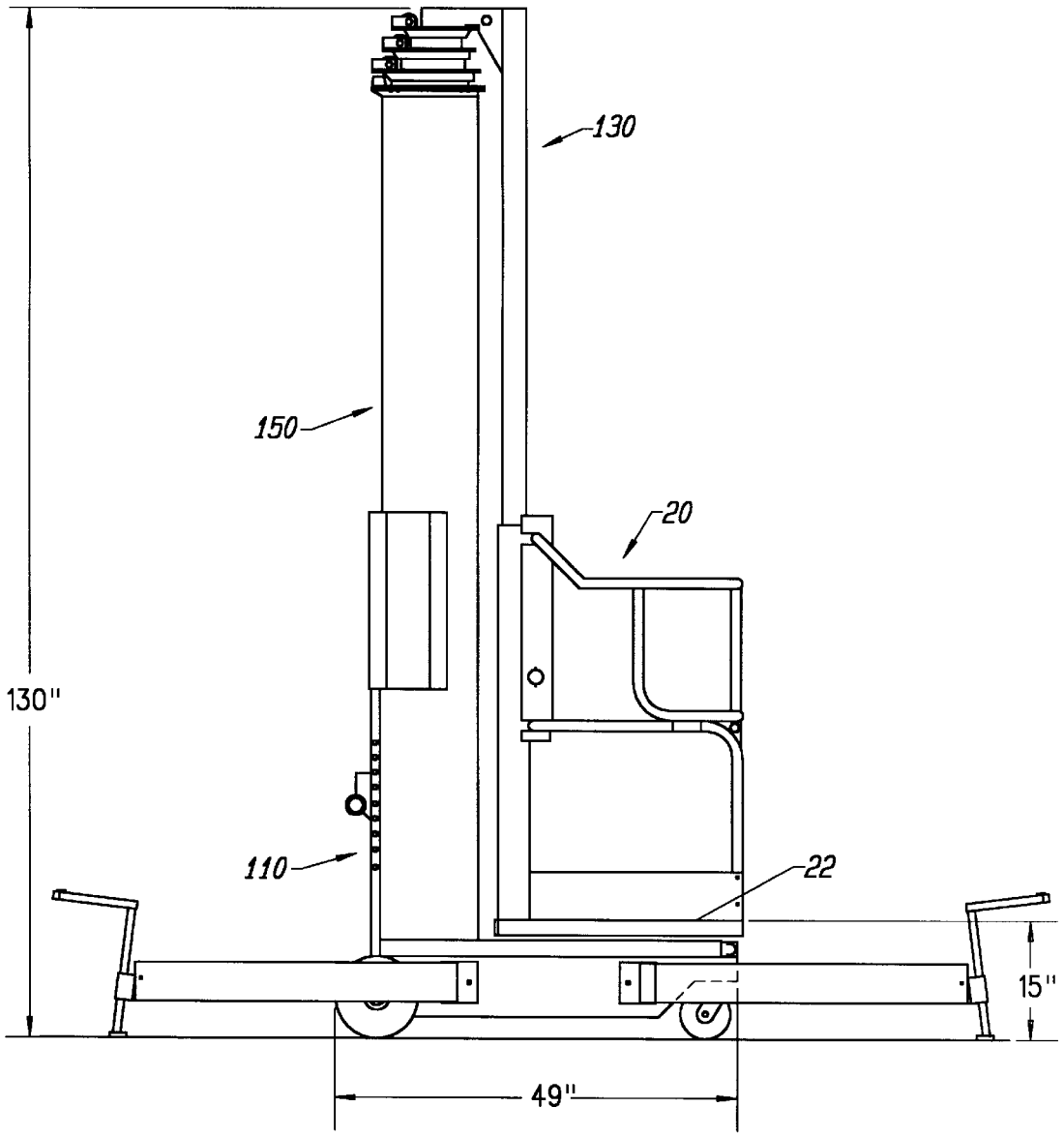
FIG. 5 is a side elevational view of a second embodiment of the movable cage assembly shown in conjunction with a 48 foot telescoping mast.

Referring to FIG. 1, a movable cage assembly shown generally as 20 is used in conjunction with a portable personnel lift shown generally as 10. The personnel lift 10 has a multi-sectional telescoping mast 50 movable between a lowermost retracted position shown in FIG. 1 and one of many elevated positions such as shown in FIG. 2. In the position shown in FIG. 1, the cage assembly is below the top 51 of mast 50. In this position, the top portion of the mast presents a work envelope obstruction. The work envelope obstruction presented by the mast becomes even more severe as shown in FIG. 5 wherein a much taller lift 110 is shown with a mast 150 capable of reaching a height of 48 feet. A primary goal of the present invention is to provide a movable cage assembly 20 which provides ground level entry as shown in FIGS. 1 and 5 but which also provides a cage which may be raised above the top 51 of mast 50 as shown in FIGS. 2 and 4. The present invention is capable of use with a telescoping mast 50 which is inherently capable of attaining greater working heights compared with a cantilevered mast design as described above.

The design of the mast 50 may be substantially as disclosed in U.S. Pat. No. 4,657,112, which is owned by the assignee of this application and the text of which patent is hereby incorporated by reference.

The personnel lift 10 has a base member 11 with wheels 12 at either end of the base member. Outriggers 13 of conventional design each has a vertically adjustable ground engaging member 14 and is attachable to the base member 11 to provide an extended area of support for the unit.

Figure 6:
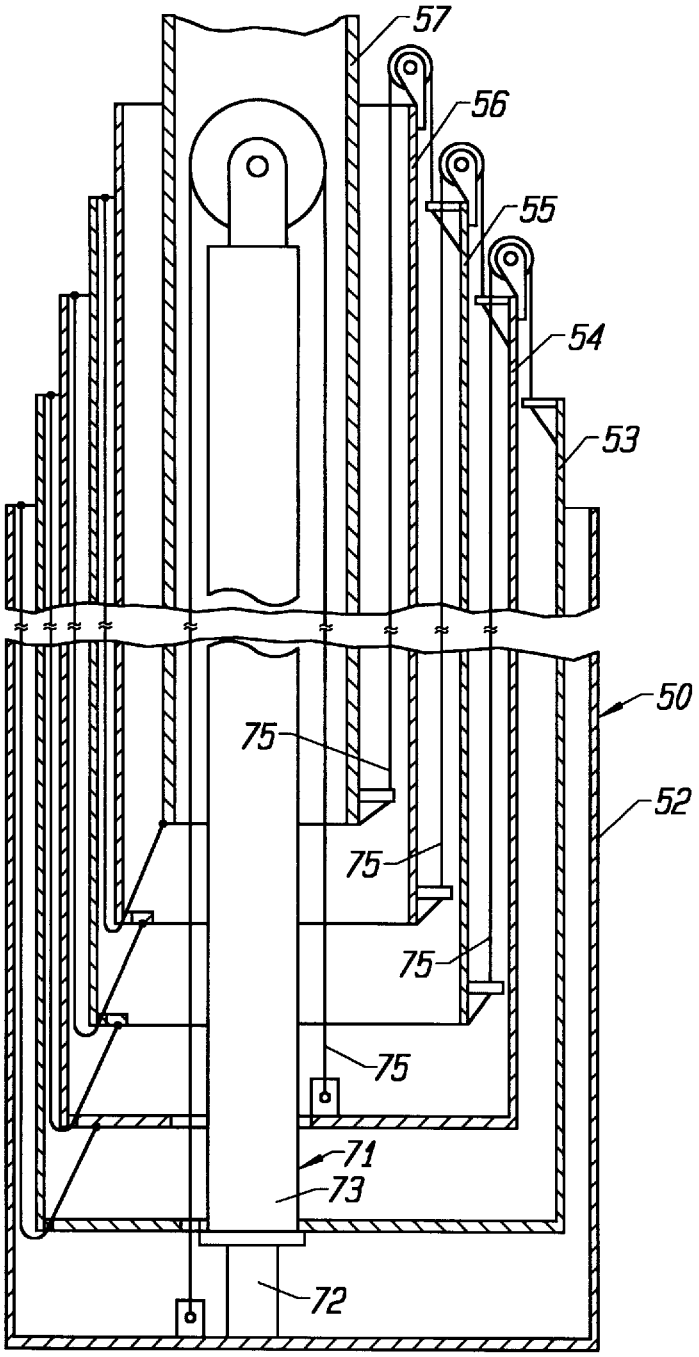
FIG. 6 is a cross-sectional view of the telescoping mast, substantially as shown in FIG. 3 of U.S. Pat. No. 4,657,112.

At one end of base member 11, a vertical mast 50 extends upwardly. The mast 50 is a telescoping mast having a plurality of telescoping or concentrically mounted sections. The embodiment shown in FIGS. 1–6 includes six sections 52, 53, 54, 55, 56 and 57. The central mast section is shown as 57. The preferred type of mast used in the present invention is the mast shown in U.S. Pat. No. 4,657,112 to Ream et al. FIG. 6 herein includes the mechanism shown in FIG. 3 of U.S. Pat. No. 4,657,112 and a detailed description of the preferred mast is not repeated here. Referring to FIG. 6, a fluid operated ram 71 has a cylinder member 73 and piston member 72. Vertical extension of ram 71 causes elevation of mast sections 53–57 by the action of chains 75 as described in detail in U.S. Pat. No. 4,657,112. However, it is to be understood that the present invention may be utilized with other telescoping mast designs. A cage support means shown generally as 30 includes an arm 31 carried by the upper end of the innermost mast section 57. A support beam 32 is welded to arm 31. Beam 32 extends downwardly and carries the weight of the movable cage assembly means 20.

The movable cage assembly means or safety cage assembly 20 includes a sleeve 21 which slides on support beam 32, and a platform or cage base means 22 on which the user stands, connected rigidly to the base of sleeve 21. Safety cage assembly 20 also has an upper safety rail means 24, which is typically waist to chest high for most users. As used herein and in the claims, when reference is made to the cage assembly being above the top of the mast, that phrase means that the upper rail 24 of cage 20 is above the top 51 of mast 50. When the upper rail 24 is above the top 51 of mast 50, the mast 50 does not restrict the user from reaching above the mast with tools, instruments, etc.

Figure 3:
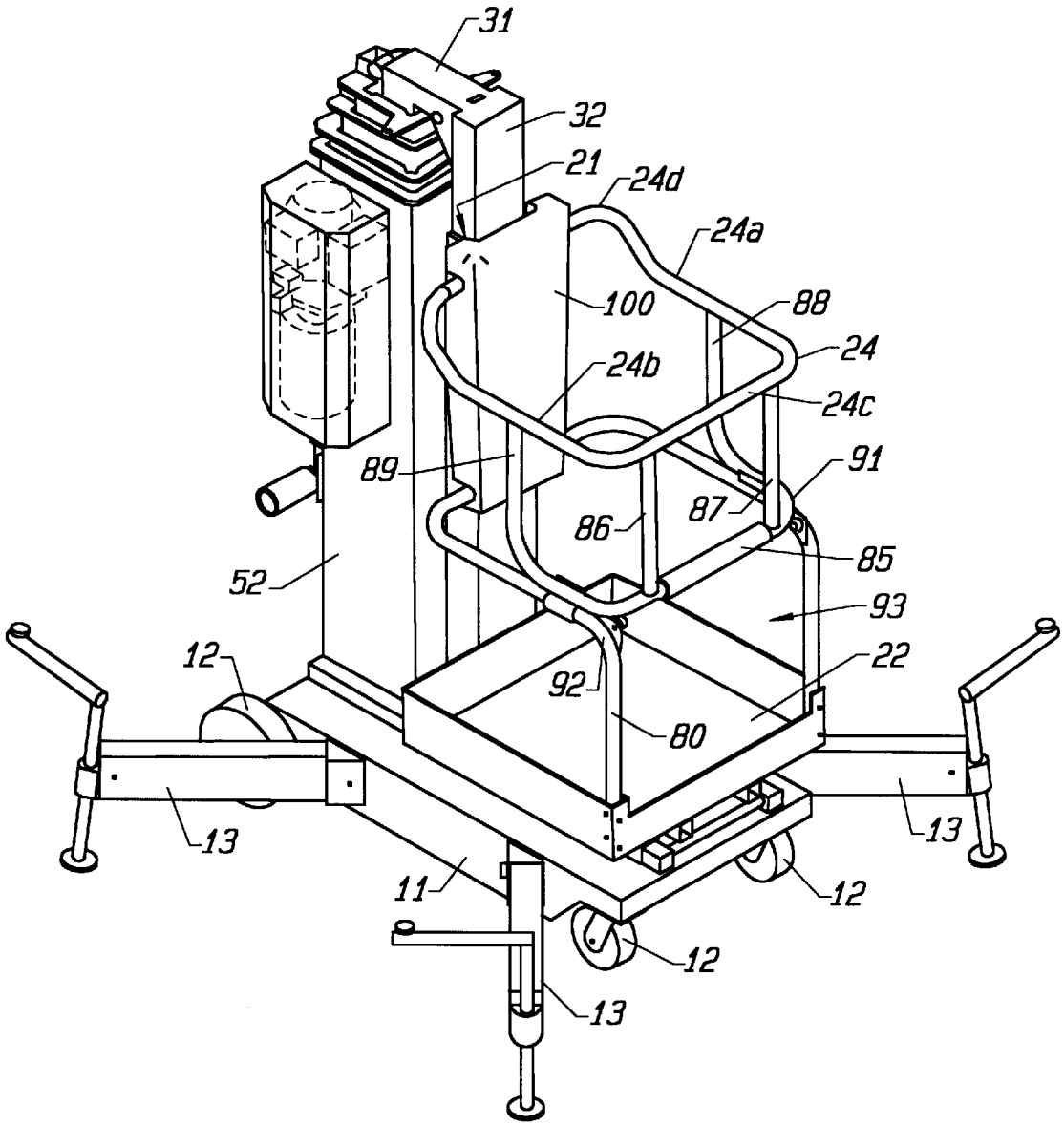
FIG. 3 is a perspective view of the movable cage assembly of the present invention shown in its lowermost, retracted position.
Figure 10:
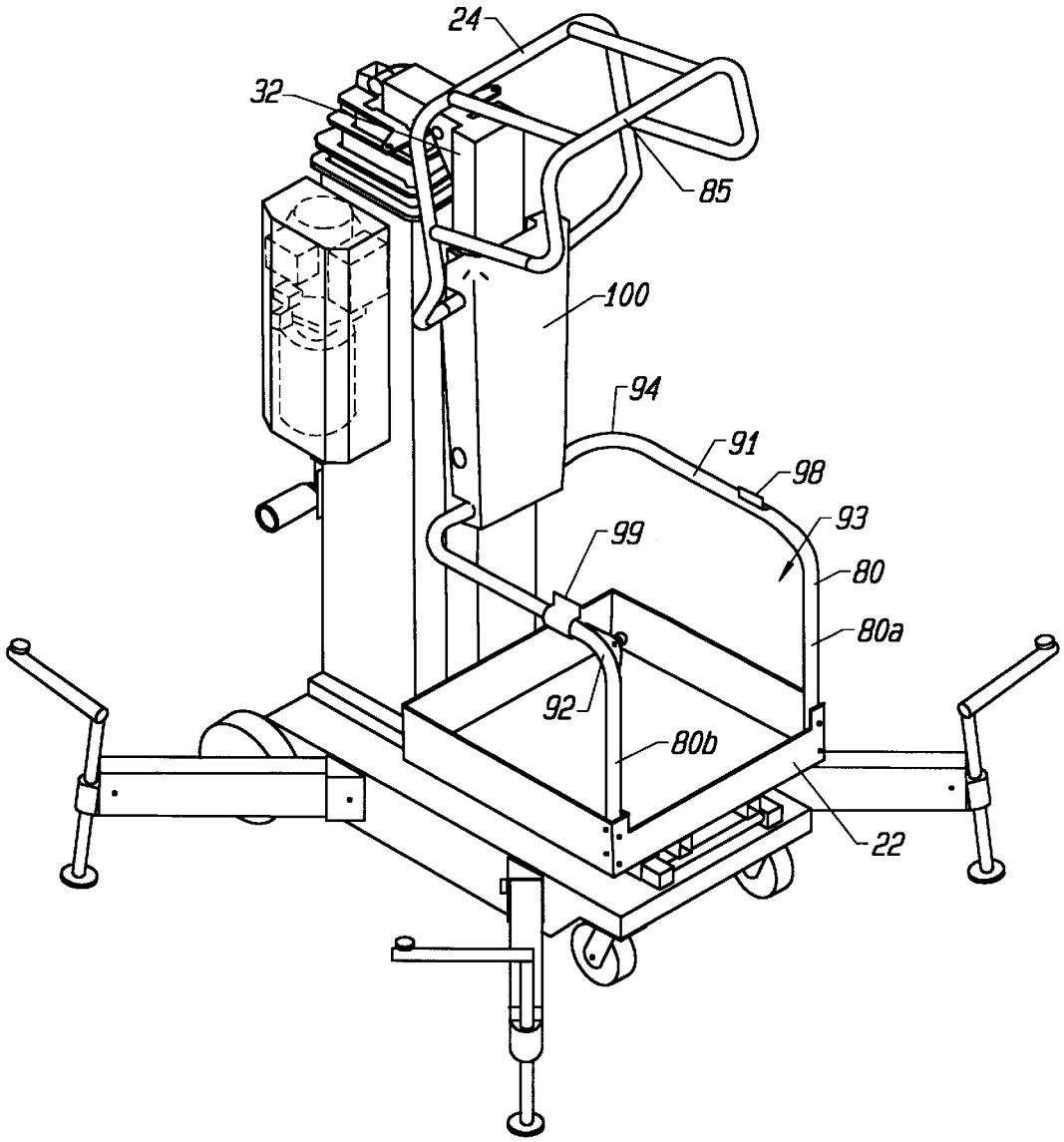
FIG. 10 is a perspective view showing the clamshell cage assembly in its open, raised position.

As shown best in FIGS. 3 and 10, safety cage assembly 20 includes a plurality of rails which form side walls 91 and 92, front wall 93 and rear wall 94. The preferred embodiment shown in FIGS. 1, 3 and 10 includes a fixed, mid-level rail 80 which extends horizontally across the rear wall 94 and side walls 91 and 92. Rail 80 includes sections 80*a* and 80*b* which extend downwardly along the edges of front wall 93 to the cage base means or platform 22.

Upper safety rail means 24 includes sections 24*a* and 24*b* which extend along side walls 91 and 92, respectively; and section 24*c* extending along front wall 93 and section 24*d* extending along rear wall 94 and pivotally connected to cage support means 30. Upper safety rail means 24 in its lowermost position shown in FIG. 3 forms a generally horizontal rail that extends around and surrounds the user when standing on the platform 22. When the user raises upper safety rail means 24 to its raised position shown in FIG. 10, the front wall 93 of the cage assembly is open, allowing the user to step onto the cage base means or platform 22 without stooping and without having to use either hand.

A horizontal, mid-level rail section 85 is connected to upper safety rail means 24 by two vertical rail sections 86 and 87 in front wall 93 and vertical rail sections 88 and 89 in side walls 91 and 92, respectively. Mid-level rail section 85 forms a mid-level enclosure around the user with fixed mid-level rail 80 in the position shown in FIG. 3.

To hold upper rail means 24 in its raised position, a gas spring 100 is mounted below rail 24 on mount 101 (FIGS. 8 and 9) and is connected to a bellcrank 102 carried by upper rail means 24. The user lowers the upper rail means 24 by pulling it downwardly to its lower, closed position.

The fixed mid-level rail 80 carries vertically extending stabilizers 98 and 99 (FIG. 10) positioned on side walls 91 and 92 to resist lateral motion of upper safety rail means 24 in its lower, closed position.

The present invention includes various means for raising the cage assembly means 20 relative to cage support means 30. In one form of the invention, the cage assembly is raised relative to the cage support means 30 sequentially as the mast 50 is elevated. In other embodiments of the invention, the user may raise the cage assembly 20 relative to the cage support means 30 independently of the elevation of mast 50.

Figure 7:
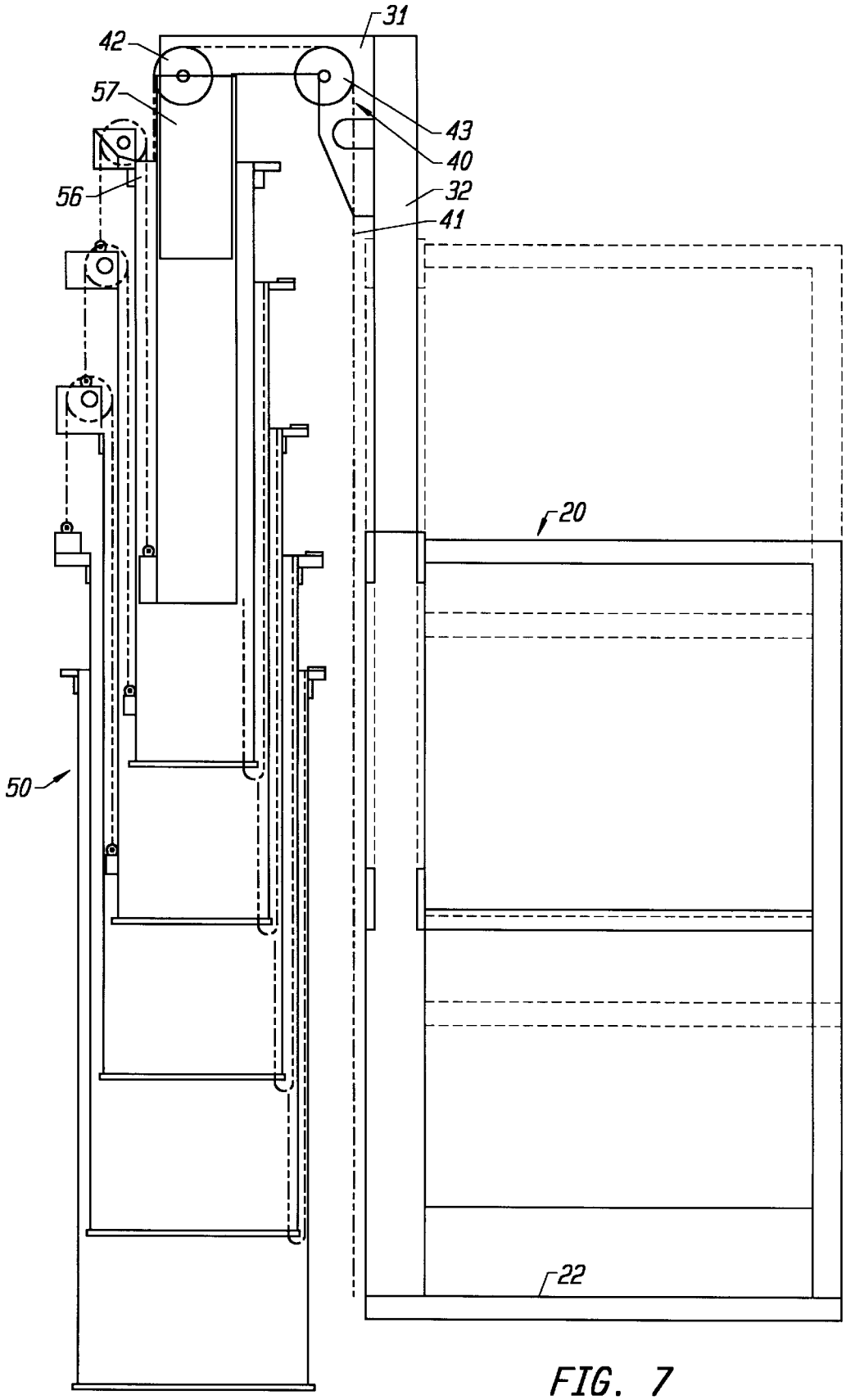
FIG. 7 is a schematic, sectional view showing the relationship of the lifting mechanism for the telescoping mast along with one type of lift mechanism for the movable cage assembly.

FIG. 7 shows one embodiment of the lift means 40 for raising the cage assembly means 20 on its cage support means 30 sequentially as the mast is elevated. In the embodiment shown in FIG. 7, a cage lift chain 41 is provided which extends from a point of attachment at the top of the mast section 56 adjacent the central mast section 57 and extends over sprockets 42 and 43 carried by arm 31 of cage support means 30 and extends downwardly and is connected to the cage assembly 20 near platform 22. As the multi-sectional mast 50 is elevated, and as arm 31 is elevated with the top mast section 57, the chain 41 raises the cage assembly 20 relative to support beam 32. In this manner, cage assembly means 20 is raised sequentially as mast 50 is elevated. Mast 50 must be elevated to its fullest height for the movable cage assembly 20 to be raised to its extreme uppermost position shown in FIG. 2.

Figure 8:
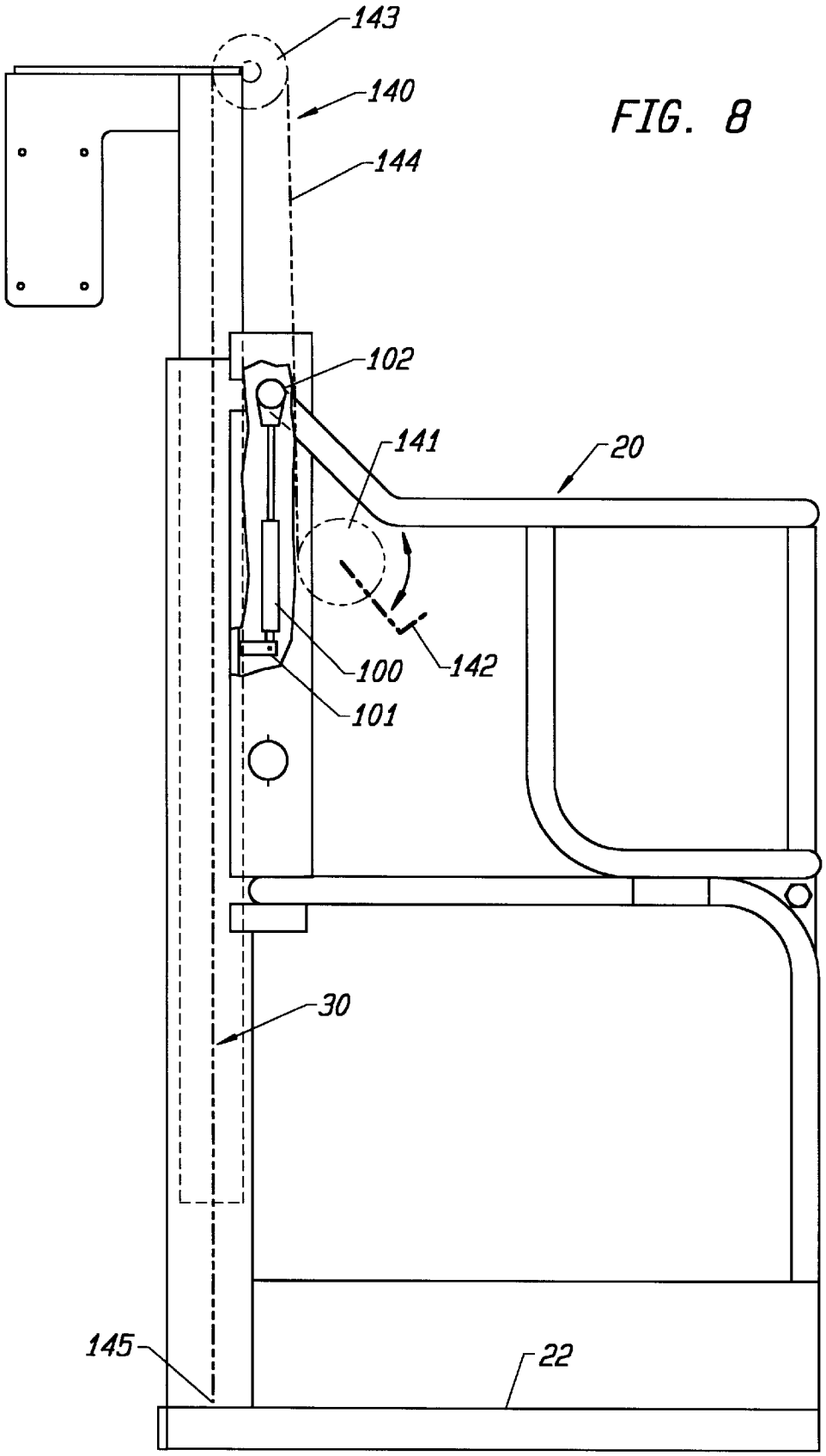
FIG. 8 is a schematic representation of another embodiment of a lift mechanism for the movable cage assembly.

Alternate means may be utilized to facilitate the raising of cage assembly 20 relative to support means 30 independent of the elevation of mast 50. For example, FIG. 8 shows a second type of lift means 140 for raising the cage assembly means 20 on cage support means 30. A hand powered winch 141 is mounted on the cage assembly 20. The winch handle 142 is rotated by the operator in one direction to raise the cage assembly on its support means 30 and, in the opposite direction, to lower the cage assembly 20 on its support means 30. A chain sprocket 143 is carried at the top of cage support means. The cage lift chain 144 is anchored to the work platform 22 at chain anchor point 145. The other end of cage lift chain 144 extends over the sprocket 143 and around the hand operated winch 141.

Figure 9:
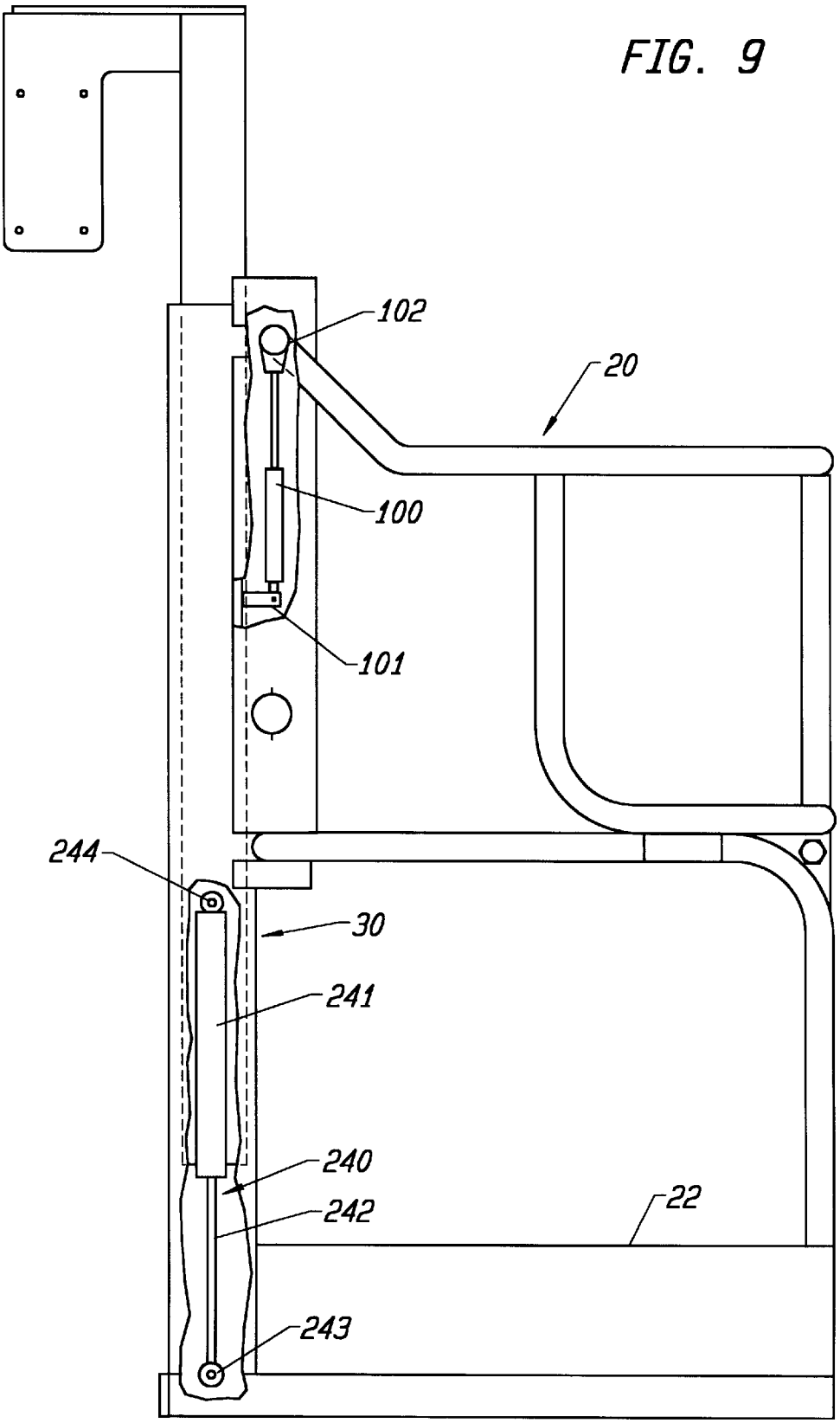
FIG. 9 is a schematic representation of a third embodiment lift mechanism for the movable cage assembly of the present invention.

A third embodiment of the cage lift means is shown in FIG. 9. In this embodiment, the lift means shown generally as 240 comprises a hydraulic cylinder 241 having a rod 242 extending downwardly and connecting to platform 22 by a pin 243. The upper end of cylinder 241 is connected to the cage support means 30 by a pin 244. As the hydraulic cylinder 241 is actuated and the rod 242 is retracted, the cage assembly 20 is lifted upwardly relative to support means 30. As the rod 242 is extended out of cylinder 241 to its fully extended position shown in FIG. 9, the cage assembly is moved to its lowermost position relative to the support means 30. It is to be understood that other types of cage lift means may be provided for moving the cage assembly relative to its support means 30. For example, a ballscrew assembly may be used in place of the hydraulic cylinder shown in FIG. 9. As noted above, it is within the spirit of this invention to use other telescoping mast designs beyond that shown herein, as well as other designs for the cage assembly and the cage lift means beyond those shown herein.

Figure 11:
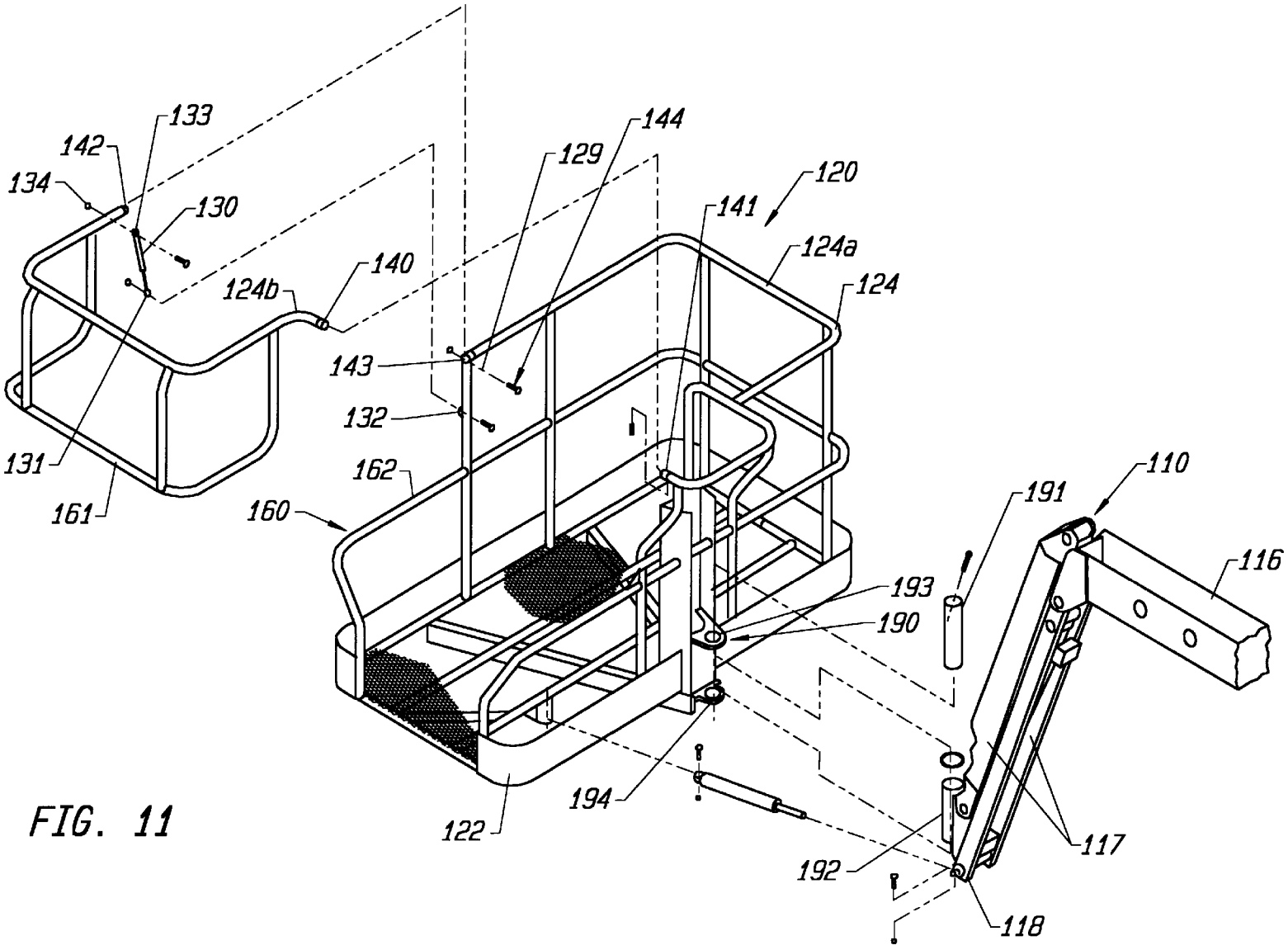
FIG. 11 is a perspective, exploded view of another embodiment of the invention used with a jib boom.
Figure 12:
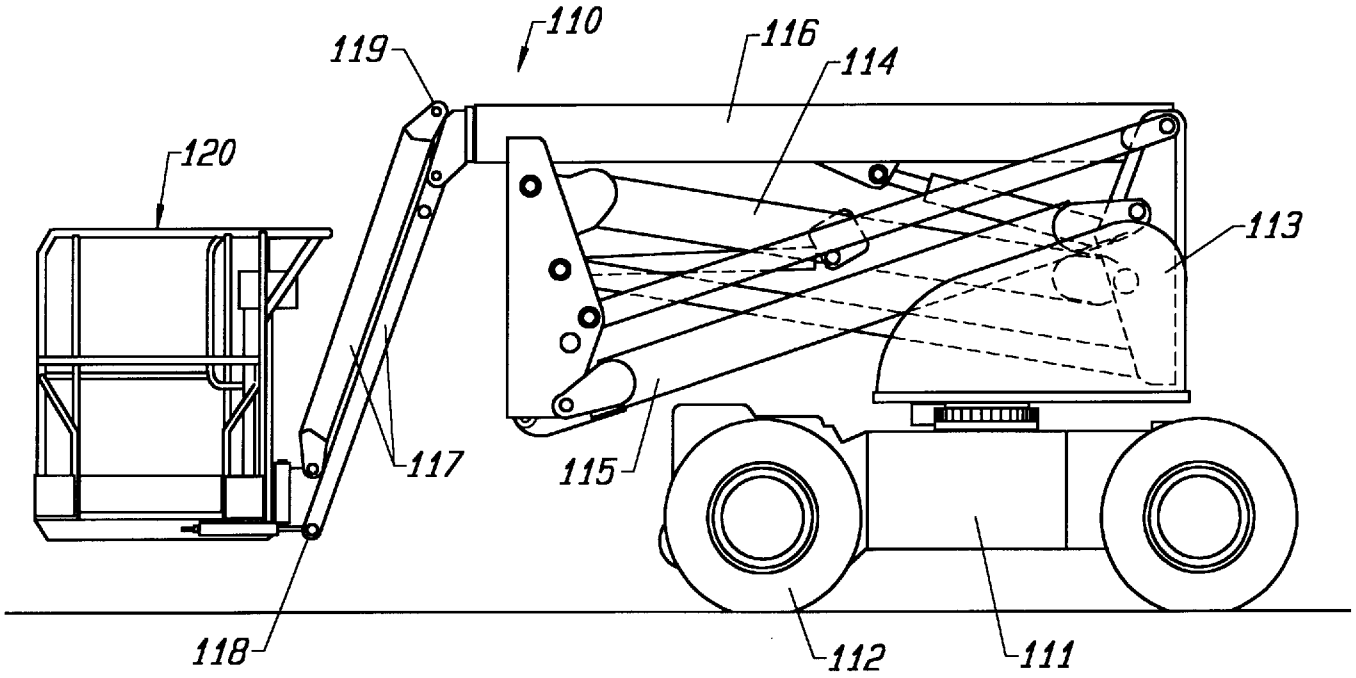
FIG. 12 is a side, elevational, schematic view of a lift showing the jib boom of FIG. 11 in its lowermost, retracted position.
Figure 13:
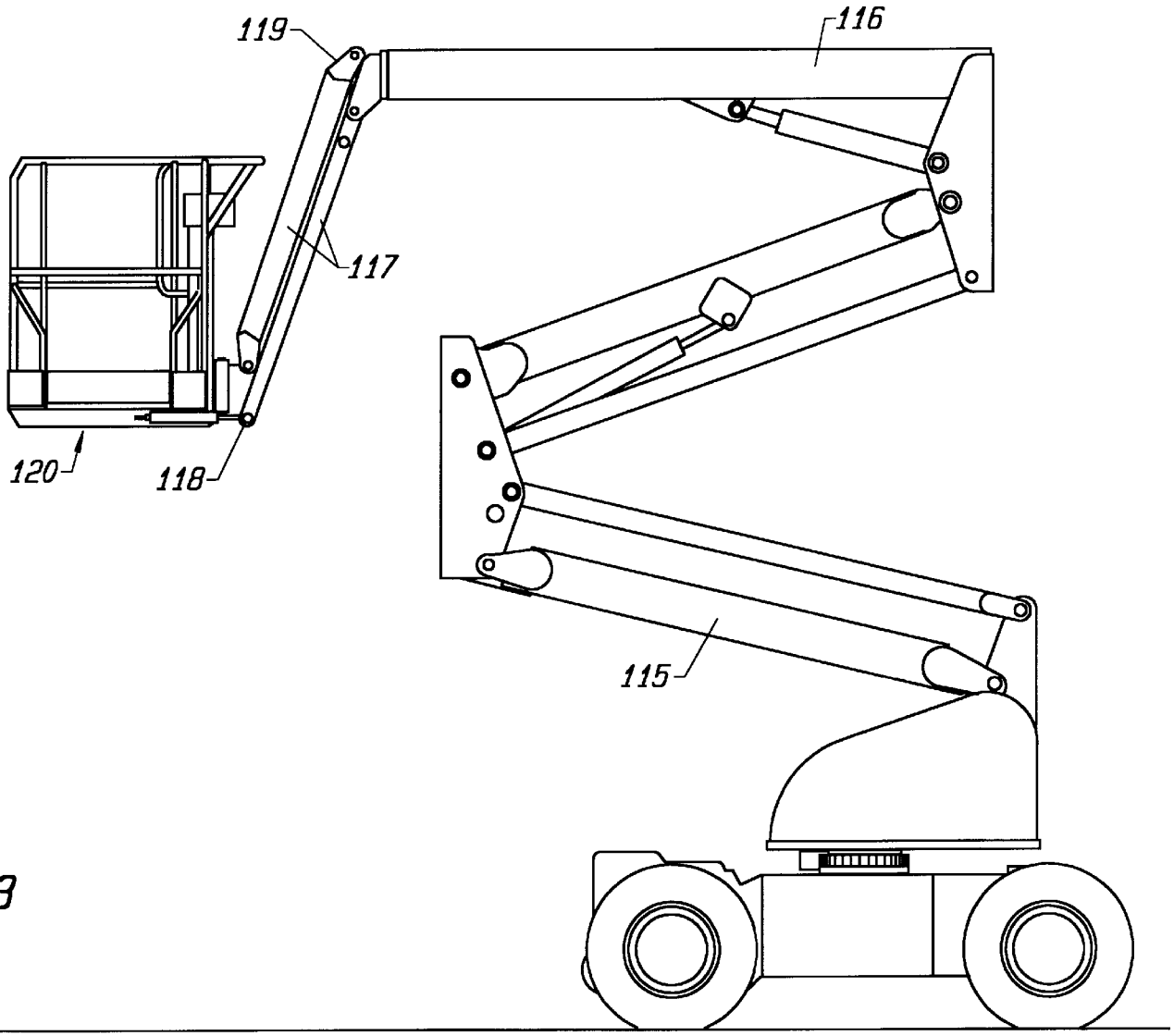
FIG. 13 is a side, elevational, schematic view of a lift showing the jib boom of FIGS. 11 and 12 in one of its elevated positions.

Referring to FIGS. 11, 12 and 13, another embodiment of the clamshell cage assembly shown as 120 is used in conjunction with a jib boom lift shown generally as 110. The jib boom lift 110 is shown in FIG. 12 with the cage assembly 120 in its fully lowered or retracted position which provides ground level entry for a user. FIG. 13 shows the cage assembly 120 in one of its elevated positions (with working height of 50 feet above the ground) in which the cage assembly provides an upper and a mid-level rail which extends around the user when standing in the cage. Referring to FIG. 12, the jib boom lift 110 has a chassis 111 supported by wheels 112. A turret 113 carries a first riser 114 and a second riser 115. The first riser 114 carries a telescoping boom 116 which in turn carries a two piece jib boom 117 with a parallelogram support structure. The jib boom 117 has a fly end 118 which carries the cage assembly 120 and a base end 119 connected to telescoping boom 116.

It is to be understood that the jib boom lift shown in FIGS. 11, 12 and 13 is one of many possible lift designs with which the clamshell cage of the present invention may be utilized. Other lift mechanisms may be used, including truck mounted designs which have only a single telescoping boom and do not have riser booms. Another alternative is that the clamshell cage of the present invention may be used with a lift having a telescoping boom and a single riser boom.

Referring to FIG. 11, the clamshell cage assembly 120 is shown in exploded view relative to the jib boom 117. The cage assembly support means 190 includes a pin 191 which extends through a sleeve 192 carried by the fly end 118 of jib boom 117. Pin 191 also extends through a pair of support brackets 193 and 194 carried by the base 122 of the cage assembly 120. Cage support means 190 cooperates with the parallelogram linkage of jib boom 117 to keep the cage assembly 120 in a constant attitude as the jib boom 117 articulates upwardly and downwardly and thereby rotates relative to telescoping mast 116.

Cage assembly 120 includes a base 122 which supports the user and which is connected to the cage support means 190. As shown in FIG. 11, cage assembly 120 is large enough to carry two users. Cage assembly 120 has an upper safety rail means 124 which is typically waist to chest high for most users. The upper safety rail means 124 includes a stationary rail **124*a* and a movable upper safety rail portion 124*b*. The movable portion 124*b* is mounted for pivotal rotation about a horizontal axis 129. The movable portion 124*b* of upper safety rail means 124*a* allows a portion of the cage assembly 120 to be moved between open and retracted positions. In the open position, the movable portion 124*b* is rotated about horizontal axis 129 and is held in its generally vertical position by a gas spring 130. Gas spring 130 is connected at its lower end 131 to a fixed bracket 132 which extends between fixed upper safety rail 124*a* and the cage base 122. The upper end 133 of the gas spring 130 is mounted to an ear 134 carried by movable upper safety rail 124*b*. Gas spring 130 assists the user in raising movable portion 124*b* to its uppermost and open position. Gas spring 130 holds the movable portion 124*b* in its upper and open position until the user pulls downwardly against the spring 130. The movable portion 124*b* has a first tubular end 140 which is bent to coincide with the horizontal axis 129 and is carried by an open receiving tubular end 141 of the fixed upper safety rail 124*a*. The second end 142 of movable upper rail 124*b* is pivotally mounted at the second end of the fixed upper rail means 143 by pin 144**.

The movable portion **124*b* of upper safety rail means carries a portion 161 of a mid-level rail means shown generally as 160 which also includes a fixed mid-level rail 162. The fixed mid-level rail extends around the safety cage 120 and cooperates with the movable portion 161 to form a mid-level rail which extends around the user when the cage is in its closed position. Therefore, in the closed position, the cage assembly 120 has an upper safety rail and a mid-level safety rail extending around the user when the user is standing in the cage. In the open position of the clamshell cage assembly, the user may enter the cage without stooping and may use both hands to carry equipment and/or tools into the cage assembly 120**.

It is to be understood that various modifications may be made to the specific design shown in the drawings without departing from the spirit of this invention and that the invention includes various types of lifts with which the clamshell cage assembly may be utilized.

What is claimed is:

1. A safety cage assembly having a clamshell opening feature for use in conjunction with a portable personnel lift wherein said lift is movable between a lowermost position wherein said cage assembly provides ground level entry for a user, and one or more elevated positions wherein said cage assembly provides a safety system to prevent said user from falling, said cage assembly comprising:

cage support means supportable by said lift, cage base means on which said user stands when in said safety cage assembly, a movable upper safety rail means pivotally mounted for rotation about a horizontal axis and movable between an open, raised position wherein said cage assembly is open and affords direct access for said user into said cage without stooping, and a closed, lower position wherein said movable upper safety rail means of said cage assembly extends at least partially around said user when standing in said cage, and a mid-level safety rail means, at least a portion of which is connected to said movable upper safety rail means, whereby said safety cage assembly in its closed position provides a mid-level rail and an upper rail extending around said user when standing in said cage.

2. The apparatus of claim 1 wherein said safety cage assembly has a front wall, a rear wall and two side walls, and wherein said mid-level safety rail means comprises:

a fixed, mid-level rail extending horizontally across said rear wall and said side walls, and extending downwardly to said cage base means along both edges of said front wall, and a horizontal, mid-level rail carried by said upper safety rail means which in said lower position of said upper safety rail means extends across and forms part of said front wall of said cage assembly.

3. The apparatus of claim 1 further comprising retainer means for holding said upper safety rail means in its open, raised position until pulled downwardly by said user.

4. The apparatus of claim 2 further comprising stabilizer means carried by said fixed, mid-level rail to resist lateral movement of said movable upper safety rail means when in its closed, lower position.

5. In combination, a personnel lift having a clamshell opening feature comprising:

a telescoping mast means comprising a plurality of mast sections, including a central mast section, cage support means carried by said central mast section, cage assembly means carried by said cage support means wherein said cage assembly means has an upper safety rail means pivotally connected to said cage support means for rotation about a horizontal axis and movable between an open, raised position wherein the front of said cage assembly is open and affords direct access for said user into said cage without stooping, and a closed, lower position wherein said upper safety rail means of said cage assembly extends around said user when standing in said cage, and a mid-level safety rail means, at least a portion of which is connected to said upper safety rail means, whereby said safety cage assembly in its closed position provides a mid-level rail and an upper rail extending around said user when standing in said cage.

6. The apparatus of claim 5 further comprising means for raising said cage assembly on said cage support means to a position wherein said cage assembly is above the top of said mast and for lowering said cage assembly on said cage assembly support means to a position below the top of said mast to allow ground level entry by a user into said cage assembly.

7. The apparatus of claim 5 wherein said cage assembly has a front wall, a rear wall, two side walls, and a base, wherein said mid-level safety rail means comprises:

a fixed, mid-level rail extending horizontally across said rear wall and said side walls, and extending downwardly to said cage base along both edges of said front wall, and a horizontal, mid-level rail carried by said upper safety rail means which in said lower position of said upper safety rail means extends across and forms part of said front wall of said cage assembly.

8. The apparatus of claim 7 further comprising retainer means for holding said upper safety rail means in its open, raised position until pulled downwardly by said user.

9. The apparatus of claim 7 further comprising stabilizer means carried by said fixed, mid-level rail to resist lateral movement of said movable upper safety rail means when in its closed, lower position.

10. In combination, a personnel lift having a clamshell opening feature boom is movable between a lowermost, retracted position wherein said cage assembly provides ground level entry for a user and one or more elevated positions wherein said cage assembly provides a safety system to prevent said user from falling, comprising:

a jib boom having a fly end and a base end, boom support means for supporting and articulating said jib boom, cage support means carried by the fly end of said jib boom, cage assembly means carried by said cage support means wherein said cage assembly means has an upper safety rail means which extends around said user when said cage is in an elevated position, and wherein said upper safety rail means has a movable portion, said movable portion being pivotally mounted for rotation about a horizontal axis and movable between an open, raised position wherein a portion of said cage assembly is open and affords direct access for said user into said cage without stooping, and a closed, lower position wherein said upper safety rail means of said cage assembly extends around said user when standing in said cage, and a mid-level safety rail means, at least a portion of which is connected to said movable portion of said upper safety rail means, whereby said safety cage assembly in its closed position provides a mid-level rail and an upper rail extending around said user when standing in said cage.

* * * * *

UNITED STATES PATENT AND TRADEMARK OFFICE

CERTIFICATE OF CORRECTION

PATENT NO. : 5,803,204

DATED : September 8, 1998

INVENTOR(S) : David D. White et al.

It is certified that error appears in the above-identified patent and that said Letters Patent is hereby corrected as shown below:

Claim 10, line 13, after "feature" delete the words --- boom is movable between a lowermost, retracted position wherein said cage assembly provides ground level entry for a user and one or more elevated positions wherein said cage assembly provides a safety system to prevent said user from falling, ---

Signed and Sealed this

First Day of December, 1998

*Attest:*

*Attesting Officer*

BRUCE LEHMAN

*Commissioner of Patents and Trademarks*